US007468094B2

(12) United States Patent
Hendricksen

(10) Patent No.: US 7,468,094 B2
(45) Date of Patent: Dec. 23, 2008

(54) METHOD OF REPAIRING AN ELECTROSTATIC PRECIPITATOR

(75) Inventor: Rodney A. Hendricksen, Clinton, NJ (US)

(73) Assignee: Hamon Research_Cottrell Inc., Somerville, NJ (US)

( * ) Notice: Subject to any disclaimer, the term of this patent is extended or adjusted under 35 U.S.C. 154(b) by 6 days.

(21) Appl. No.: 11/702,296

(22) Filed: Feb. 5, 2007

(65) Prior Publication Data

US 2007/0193444 A1 Aug. 23, 2007

Related U.S. Application Data

(60) Provisional application No. 60/776,019, filed on Feb. 23, 2006.

(51) Int. Cl.
*B03C 3/86* (2006.01)

(52) U.S. Cl. ..... 95/57; 96/83; 96/87; 96/92

(58) Field of Classification Search ..... 96/83, 96/86, 87, 89, 92, 94–100; 95/57
See application file for complete search history.

(56) References Cited

U.S. PATENT DOCUMENTS

| | | | | | |
|---|---|---|---|---|---|
| 1,584,055 | A * | 5/1926 | Weiskopf | ..... | 96/92 |
| 1,846,169 | A * | 2/1932 | Weiskopf | ..... | 96/84 |
| 2,711,224 | A * | 6/1955 | Herber | ..... | 96/89 |
| 2,999,561 | A * | 9/1961 | Phyl | ..... | 96/89 |
| 3,688,475 | A * | 9/1972 | Dyla et al. | ..... | 96/92 |
| 3,729,815 | A * | 5/1973 | Quintilian et al. | ..... | 29/592.1 |
| 3,759,014 | A * | 9/1973 | Van Dyken et al. | ..... | 95/76 |
| 4,303,418 | A * | 12/1981 | Coe, Jr. | ..... | 96/86 |
| 4,325,714 | A * | 4/1982 | Wooldridge | ..... | 96/86 |
| 4,360,367 | A * | 11/1982 | Prior | ..... | 96/87 |
| 4,375,364 | A * | 3/1983 | Van Hoesen et al. | ..... | 96/87 |
| 4,516,992 | A * | 5/1985 | Jonelis | ..... | 96/87 |
| 4,559,064 | A * | 12/1985 | Ahern | ..... | 96/87 |
| 4,747,856 | A * | 5/1988 | Hicks et al. | ..... | 96/86 |
| 4,840,649 | A * | 6/1989 | Jonelis et al. | ..... | 96/94 |
| 4,948,399 | A * | 8/1990 | Reuffurth et al. | ..... | 96/92 |
| 5,344,481 | A * | 9/1994 | Pettersson | ..... | 96/33 |
| 5,366,540 | A * | 11/1994 | Bojsen | ..... | 96/33 |
| 5,529,608 | A * | 6/1996 | Jonelis | ..... | 95/57 |
| 5,665,147 | A * | 9/1997 | Taylor et al. | ..... | 96/72 |
| 6,048,385 | A * | 4/2000 | Koide | ..... | 96/83 |
| 6,579,349 | B1 * | 6/2003 | Ting et al. | ..... | 96/44 |
| 2007/0193449 | A1 * | 8/2007 | Smith | ..... | 96/83 |

FOREIGN PATENT DOCUMENTS

| | | | | | |
|---|---|---|---|---|---|
| DE | 3540748 | A1 * | 5/1986 | ..... | 96/83 |

* cited by examiner

*Primary Examiner*—Richard L Chiesa
(74) *Attorney, Agent, or Firm*—Howard & Howard Attorneys, P.C.

(57) ABSTRACT

A method of repairing an electrostatic precipitator, including building a temporary support truss assembly, supporting the temporary truss assembly at the level of the hot roof of the electrostatic precipitator, transfeffing the weight of the internal components of the electrostatic precipitator from the upper girders to the temporary truss assembly, repairing or replacing the upper girders of the electrostatic precipitator, and then transferring the weight of the internal components to the repaired or replaced upper girders.

8 Claims, 3 Drawing Sheets

METHOD OF REPAIRING AN ELECTROSTATIC PRECIPITATOR

RELATED APPLICATION

This application claims priority to U.S. Provisional Patent Application Ser. No. 60/776,019 filed Feb. 23, 2006.

FIELD OF THE INVENTION

This invention relates to a method of repairing or replacing the upper girders, including the top end frames and intermediate roof beams, and the hot roof, if required, of an electrostatic precipitator without requiring the complete disassembly of the electrostatic precipitator including the collecting electrodes and discharge electrodes, significantly reducing the cost of repair.

BACKGROUND OF THE INVENTION

As will be understood by those skilled in this art, a conventional electrostatic precipitator includes casing walls, or side frames, typically enclosing a plurality of rectangular chambers and fields, and the chambers are separated by longitudinal partition frames, sometimes referred to collectively here as the casing walls. Each chamber and field includes a plurality of parallel spaced vertically extending plate-like collecting electrodes, which may, for example, be up to 50 feet in length and 15 feet in width, and a plurality of discharge electrodes supported on an electrically isolated high voltage frame assembly to keep the discharge electrodes in proper alignment with the collecting electrodes. A high voltage direct current is applied to the discharge electrodes. When particulate laden process gas is passed at low velocity through this field, the particulates in the gas stream become negatively charged in the electron field. The particles are then attracted to the positive charge on the collecting electrode surfaces. When the migration toward the surfaces of the collecting electrodes is complete, the inherent resistivity of the particles will prevent complete loss of the charge to the collecting electrode surfaces and the particles will then agglomerate on the surfaces of the collecting electrodes. The particulates are then collected in a grid of hoppers located below the collecting electrodes.

As will be understood, as an electrostatic precipitator casing ages, it typically deteriorates from the corrosive atmosphere in which it operates. Some electrostatic precipitator units that have been in operation for 30 to 40 years may exhibit significant deterioration in their structural integrity, particularly the upper girders and hot roof. Depending upon the original design configuration, application and the quality of the original installation, certain areas of the electrostatic precipitator may need to be repaired or more generally replaced. The costs associated with rebuilding an electrostatic precipitator are significant. Where repair or replacement is required, there are also significant costs associated with shutting down the electrostatic precipitator, which generally requires shutting down the process or equipment generating the waste gas stream.

Electrostatic precipitators with insulator compartments instead of the now more customary Penthouse design are more susceptible to corrosion of the hot roof area, including the top flanges of the top end frames and intermediate roof beams because of their direct exposure to severe weather conditions. Cold temperatures and cooling effects of rain and snow can accelerate corrosion by causing the internal steel temperature to drop below the Acid Dew Point of the process gases. This results in various types of acids condensing on the cold steel surfaces, resulting in oxidation, corrosion and accelerated deterioration of these components.

A major repair of the upper girders, including the top end frames and intermediate roof beams, of an electrostatic precipitator will generally require relieving the load from the girders before repairs can be made. The load on the girders includes the collecting electrodes, discharge electrodes, high voltage frames and hot roof. Thus, the present method of repair or replacement of these elements is very labor intensive, expensive and typically requires an extended plant outage to complete the work.

FIGS. 3 and 4 illustrate the upper portion of one embodiment of a conventional electrostatic precipitator. As shown in FIG. 4, the discharge electrodes 34 of the electrostatic precipitator are supported by T-bars 37 which include pipes extending through the support insulators 38 supported on the hot roof 32. The collecting electrodes 40 are supported by the anvil beams 42 shown in FIG. 4. As best shown in FIG. 3, the discharge electrodes 34 are supported by high voltage support frames 36, which are supported by the T-bars 37 on support insulators 38 on the hot roof 32. As described in more detail herein, an object of this invention is to repair the electrostatic precipitator by replacing the upper girders 60 and 62, for example, without removing the discharge and collecting electrodes 34 and 40, respectively, and potentially replacing the hot roof 32.

The method of repairing an electrostatic precipitator of this invention eliminates the requirement for removal of the discharge and collecting electrodes 34 and 40, respectively, high voltage frames, etc. of an electrostatic precipitator during repair or replacement of the upper girders and hot roof, if required. The method of repair of an electrostatic precipitator of this invention thus significantly reduces the cost of repair and the down time of the electrostatic precipitator and the equipment of apparatus generating the waste gas stream treated by the electrostatic precipitator.

SUMMARY OF THE INVENTION

The method of repairing an electrostatic precipitator of this invention includes building a temporary support truss assembly, preferably having vertical members and horizontal truss members. The method of this invention then includes supporting and fixing the temporary support truss assembly on the electrostatic precipitator, preferably at the level of the hot roof, wherein the vertical truss members of the temporary support truss assembly are supported on the structural casing walls or side frames and partition frames of the electrostatic precipitator. The method of this invention then includes transferring the weight of the internal electrical components of the electrostatic precipitator, including the discharge electrodes, collecting electrodes and high voltage frames from the upper girders of the electrostatic precipitator, including the top end frames and intermediate roof beams, to the temporary support truss assembly. The method of this invention then includes repairing or replacing the upper girders of the electrostatic precipitator, and then transferring the weight of the electrical components of the electrostatic precipitator from the temporary support truss assembly to the repaired or replaced upper girders. In most applications, the temporary support truss is then removed. As will be understood, this method of repairing an electrostatic precipitator of this invention significantly reduces the cost of repair and down time of the electrostatic precipitator and therefore the down time of the facility generating the waste gas stream cleaned by the electrostatic precipitator.

The method of this invention may also be utilized to replace the hot roof of the electrostatic precipitator, which is also subject to exposure to severe weather conditions and therefore generally requires replacement at the time of the replacement or the repair of the upper girders. In one preferred embodiment of the method of this invention, the temporary support truss assembly is fixed to the hot roof of the electrostatic precipitator by brackets welded or otherwise affixed to the hot roof. The method of this invention may then include the complete removal and replacement of the hot roof.

In one disclosed embodiment of the method of repairing an electrostatic precipitator with this invention, the method includes supporting the collecting electrode anvil beams of the electrostatic precipitator on temporary support truss hanger rods suspended from the temporary support truss assembly. Further, in a disclosed embodiment of the method of this invention, the method includes lowering the high voltage support frames, which support the discharge electrodes, onto the collecting electrodes, such that both the discharge electrodes and the collecting electrodes are or will be temporarily supported by the temporary support truss assembly. The method of this invention thus eliminates the requirement for removing the internal electrical components of the electrostatic precipitator when repairing or replacing the upper girders of the electrostatic precipitator, including the top end frames and intermediate roof beams, thus substantially reducing the cost and time of repair and downtime of the electrostatic precipitator.

Other advantages and meritorious features of this invention will be more fully understood from the following description of the preferred embodiments and the drawings, a brief description of which follows.

DESCRIPTION OF THE PREFERRED EMBODIMENTS

As will be understood by those skilled in this art, the disclosed embodiments of the apparatus utilized in the method of repairing an electrostatic precipitator of this invention are for illustrative purposes only and various modifications may be made to the disclosed method of this invention within the purview of the appended claims. As described above, the method of this invention may be utilized to repair or replace the upper girders of an electrostatic precipitator without requiring removal of the electrical internal components from the electrostatic precipitator including the collecting electrodes, discharge electrodes and the high voltage frames. The method of this invention may also be utilized to repair or replace the hot roof of the electrostatic precipitator as described herein.

Figure 1:
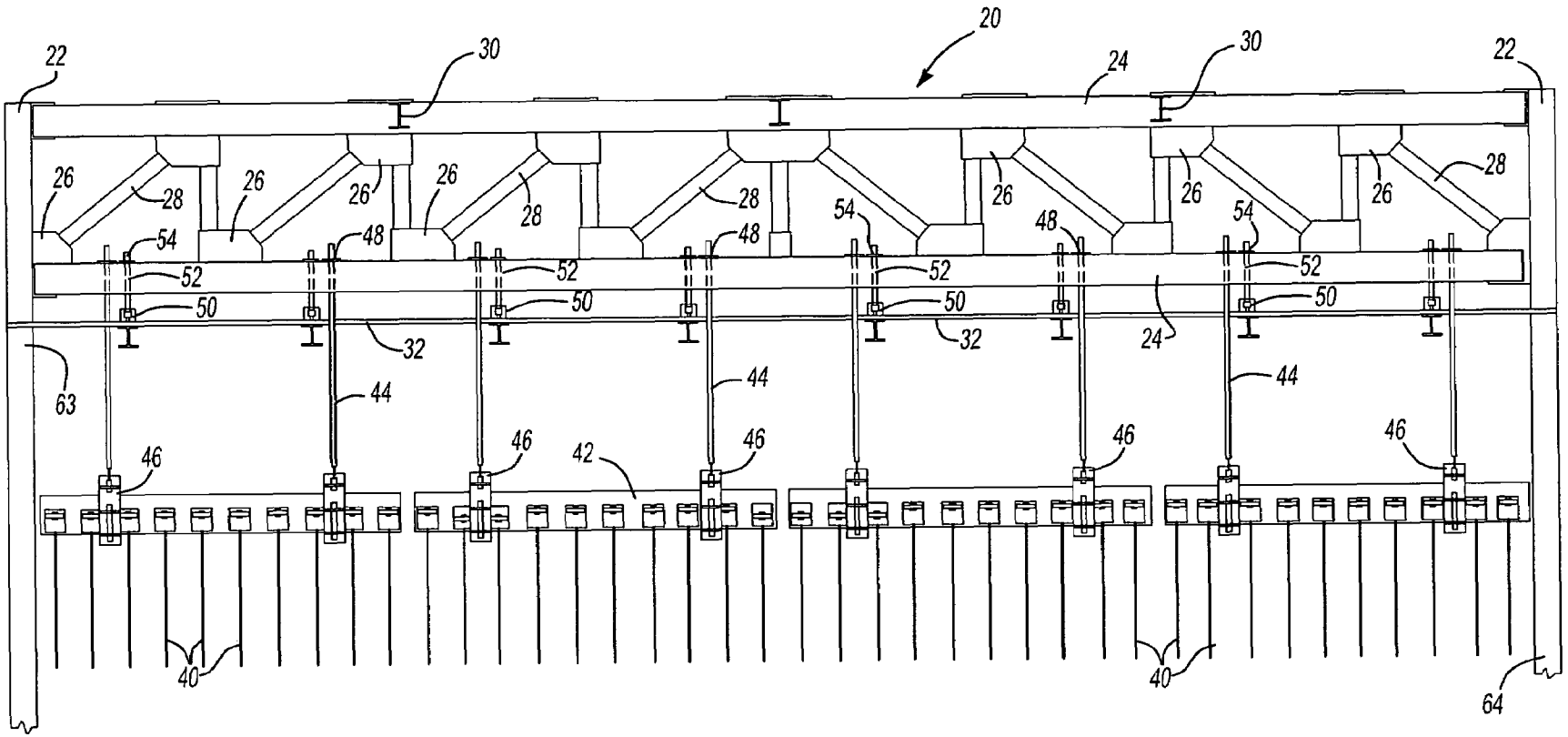
FIG. 1 is a sectional end elevation of the upper portion of an electrostatic precipitator with the temporary support truss assembly in place during repair of the electrostatic precipitator.
Figure 2:
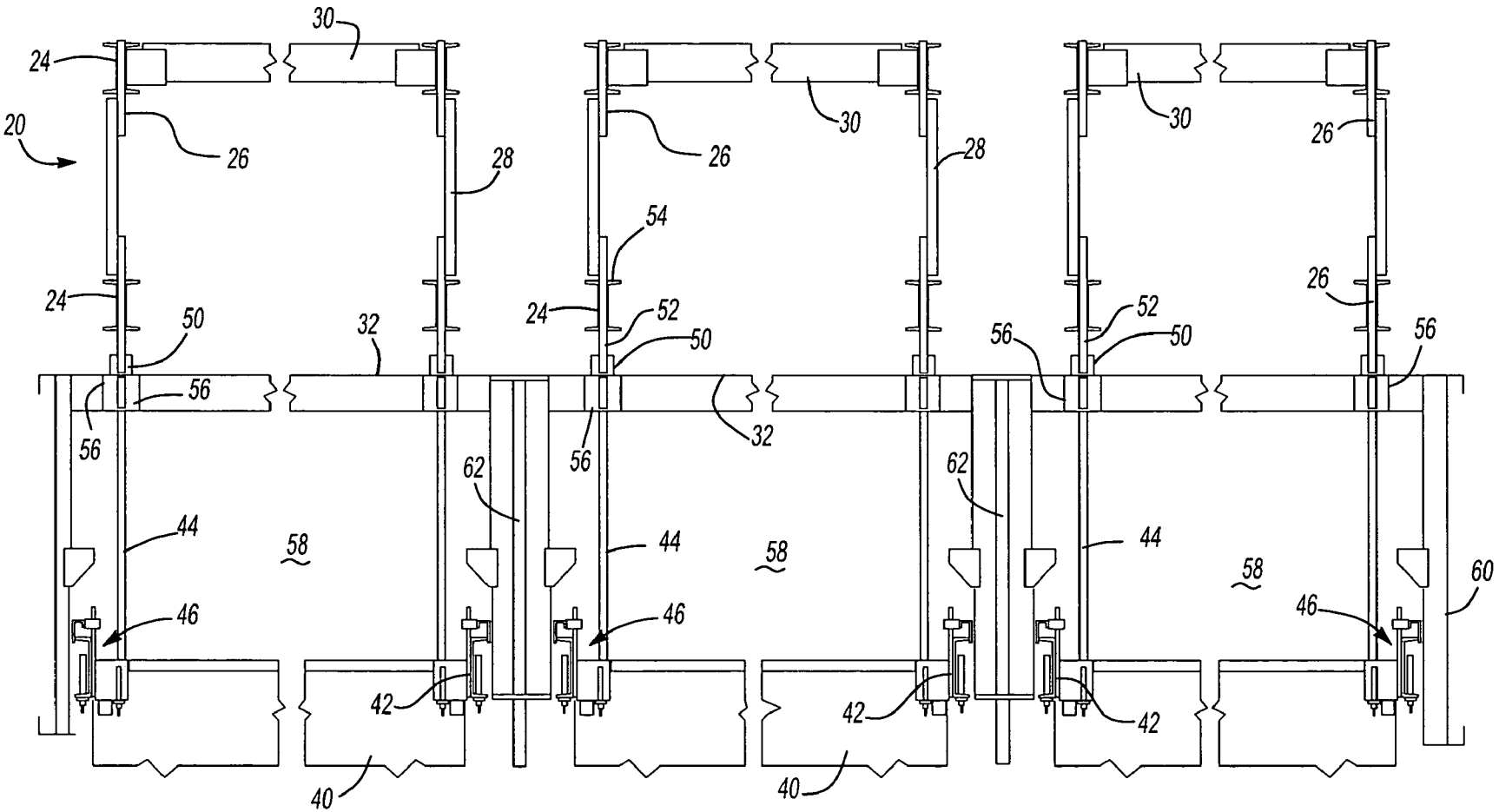
FIG. 2 is a sectional side elevation of FIG. 1.

The method of this invention includes first building a temporary truss assembly, one embodiment of which is shown at 20 in FIGS. 1 and 2, for temporarily supporting the internal components of the electrostatic precipitator during repair or replacement of the upper girders 60 and 62 as described. The temporary support truss assembly 20 may preferably be prefabricated off site or at the site of the electronic precipitator or fabricated in situ as shown in the Figures. As will be understood, however, the preferred embodiments of the temporary support truss assembly 20 will depend upon several factors, including the configuration of the electrostatic precipitator, the components of the electrostatic precipitator to be repaired or replaced and other factors. Thus, the method of this invention is not limited to any specific configuration of the temporary support truss assembly 20, such as disclosed in FIGS. 1 and 2. In one preferred embodiment, the temporary support truss assembly 20 also includes vertical support truss members 22 and horizontal side truss members 24 best shown in FIG. 1. In the disclosed embodiment, the temporary support truss assembly 20 also includes a plurality of gusset plates 26, which may be welded or otherwise secured to the horizontal side truss members 24 and the vertical support truss members 22, and angle truss members 28 may be further provided by welding or otherwise securing the ends of the angle truss members 28 to the gusset plates 26 for additional strength and support. As shown in FIG. 2, transverse horizontal support truss members 30 may also be provided for additional support. In the disclosed embodiment, the truss members are steel C-shaped members or back to back channels, but any suitable truss assembly may be utilized.

In one preferred embodiment of the method of repairing an electrostatic precipitator of this invention, the vertical support truss members 22 of the temporary support truss assembly 20 are supported on the electrostatic precipitator above or in line with the casing walls or side frames and generally the partition frames of the electrostatic precipitator such that the bearing load on the temporary support truss assembly 20 is fully supported by the casing walls 63, sometimes referred to as the side frames, and the partition frames 64 of the electrostatic precipitator. As discussed below, in one preferred embodiment of the method of this invention, the temporary support truss assembly 20 is supported at the hot roof elevation 32 of the electrostatic precipitator (see also FIGS. 3 and 4) in a manner permitting removal and replacement of the hot roof 32 as further described below.

Figure 3:
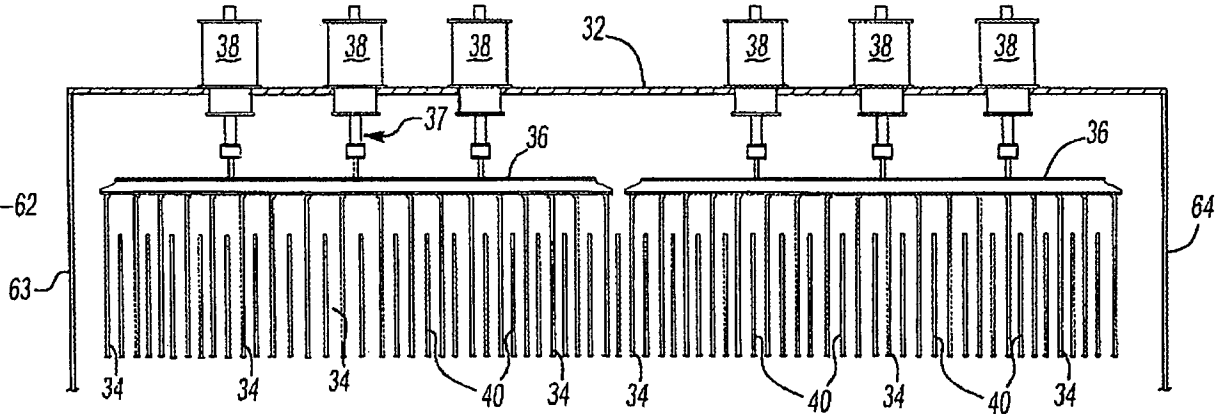
Fig-3 Prior Art
FIG. 3 is a drawing illustrating the support of the discharge electrodes in a conventional electrostatic precipitator or prior art.
Figure 4:
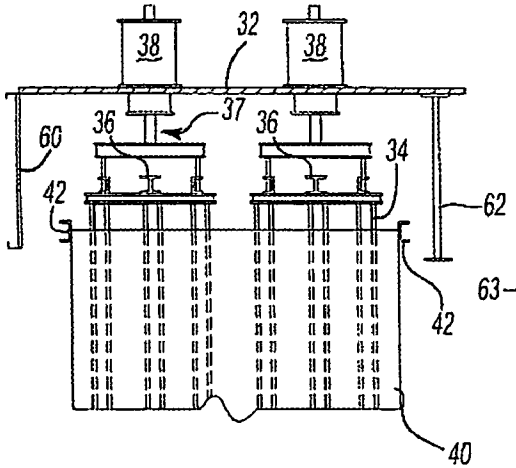
Fig-4 Prior Art
FIG. 4 is a sectional side elevation of FIG. 3.

The internal components or more accurately, the weight of the internal components is then transferred from the upper girders 60 and 62 of the electrostatic precipitator to the temporary support truss assembly 20. As will be understood by those skilled in this art, this can be accomplished in various ways. In one preferred embodiment, the weight of the discharge electrodes 34 is first transferred to the collecting electrodes 40 and the anvil beams 42 supporting the collecting electrodes 40 are then transferred to the temporary support truss assembly 20 as now described. As will be understood by those skilled in this art and as shown in FIG. 3, the discharge electrodes 34 are conventionally supported by the high voltage support frames 36 (as also shown in FIGS. 3 and 4) and the high voltage support frames 36 are supported on the hot roof 32 by the support insulators 38, again as shown in FIG. 3. In one embodiment of the method of repairing an electrostatic precipitator of this invention, the high voltage support frames 36 which support the discharge electrodes 34 are lowered until they rest on the collecting electrodes 40. This may be done with a crane, winch or other device. As will be understood, the method of this invention will typically include removing by cutting or otherwise removing the support of the high voltage support frame 36 prior to lowering the high voltage support frames 36 and the discharge electrodes 34 onto the collecting electrodes 40. This can be done at any time during the method of this invention.

The method of this invention further includes transferring the weight of the collecting electrodes 40 (and thus also the discharge electrodes 34 and the high voltage support frames 36) from the upper girders of the electrostatic precipitator to the temporary support truss assembly 20. As will be understood by those skilled in this art, the collecting electrodes 40 are typically suspended from anvil beams 42 as shown in the Figures. Thus, in one preferred embodiment of the method of this invention, the anvil beams 42 are temporarily suspended from the temporary support truss assembly 20. As will be understood, the anvil beams 42 may be suspended by any suitable means from the temporary support truss assembly 20. In the disclosed embodiment of the method of this invention, the anvil beams 42 are suspended from the lower side truss members 24 by temporary support truss hanger rods 44 and brackets 46 as shown in FIG. 2. The temporary support truss hanger rods 44 may be received through openings in the hot roof 32 and clamped by any suitable means to the anvil beam 42, such as the hanger rod support assemblies 46 shown in FIGS. 1 and 2. The upper ends of the temporary support truss hanger rods 44 are received through openings in the lower horizontal support truss members 24 and supported on the upper end by a plate washer and nut assembly as shown at 48 in FIG. 1. As will be understood, the hot roof 32 must be supported by elements 50, 52 and 54 before the upper girders 60 and 62 can be removed. Once the anvil beams 42 are supported on the temporary support truss assembly 20, the upper girders, including the top end frames and intermediate roof beams may be removed and replaced.

In a typical application, the top end frames and intermediate roof beams are removed with a cutting torch or the like and new upper girders are welded or otherwise secured in place in a conventional manner used to make a conventional electrostatic precipitator. The weight of the collecting electrodes 40, discharge electrodes 34 and the high voltage frames 36 (shown in FIG. 3) may then be transferred from the temporary support truss assembly to the upper girders in a conventional manner. That is, the high voltage support frame may then be raised and the weight of the collecting electrodes 40 and the anvil beam 42 is again supported by the upper girders as will be understood by those skilled in this art.

The method of repairing an electrostatic precipitator of this invention may also be utilized to repair or replace the hot roof 32 of the electrostatic precipitator. If the upper girders 60 and 62 are not replaced, there are other methods of replacing the hot roof 32. As will be understood by those skilled in this art, the hot roof 32 of the electrostatic precipitator is also exposed to the elements and generally must be replaced with the replacement of the upper girders of the electrostatic precipitator. In the disclosed embodiment of the method of repairing an electrostatic precipitator with this invention, the temporary support truss assembly 20 is affixed at the hot roof 32 elevation and the hot roof may then removed and replaced. In a disclosed embodiment of the method of this invention, the lower horizontal support truss members 24 are affixed to U-shaped brackets or hanger rod clips 50 which are welded or otherwise secured to the hot roof 32 as shown in FIGS. 1 and 2. The lower horizontal truss members 24 are then affixed to the brackets by temporary support truss hanger rods 52 as shown in FIGS. 1 and 2. The lower ends of the temporary support truss hanger rods 52 may be secured to the U-shaped brackets 50 by nuts (not shown) and the upper end is supported by a nut and plate assembly 54 as best shown in FIG. 1. The vertical support truss members 22 are attached by bolts or rods to the side frames and/or the partition frames as set forth in FIG. 1. Finally, the old hot roof is removed by any suitable means, such as by a cutting torch by cutting along the cut lines 56 shown in FIG. 2 and a new hot roof is installed by conventional means used to assemble a conventional electrostatic precipitator.

As will be understood by those skilled in this art, various modifications may be made to the method of repairing an electrostatic precipitator with this invention within the purview of the appended claims. As set forth above, the preferred configuration of the temporary support truss assembly 20 will depend upon the configuration of the electrostatic precipitator and the components of the electrostatic precipitator to be repaired or replaced. As will be understood by those skilled in this art, a conventional electrostatic precipitator includes a plurality of chambers and fields. The sectional end elevation of FIG. 1 illustrates one chamber of an electrostatic precipitator and FIG. 2, which is a cross-section transverse to FIG. 1 illustrates three fields 58 of a conventional electrostatic precipitator. Further, the internal components of the electrostatic precipitator may be supported on the temporary support truss assembly by any suitable means including, but not limited to, supporting the anvil beam 42 on temporary support truss hanger rods 44. The upper girders (top end frames item 60 in FIG. 2 and intermediate roof beams item 62 in FIG. 2) of the electrostatic precipitator may be removed and replaced by any suitable means in a conventional manner according to the construction and configuration of the electrostatic precipitator. Having described preferred embodiments of the method of repairing an electrostatic precipitator of this invention, the method of this invention is now claimed as follows.

The invention claimed is:

1. A method of repairing an electrostatic precipitator, said electrostatic precipitator including an enclosure defined by casing walls having a hot roof, an upper girder assembly, collecting electrodes, discharge electrodes and high voltage frames supported on the upper girder assembly, said method comprising the following steps:

making a temporary support truss assembly having vertical truss members;

supporting and fixing the temporary support truss assembly on the electrostatic precipitator above the casing walls;

transferring the weight of the collecting electrodes, discharge electrodes and high voltage frames from the upper girder assembly of the electrostatic precipitator to the temporary support truss assembly;

repairing or replacing the upper girder assembly and other components of the electrostatic precipitator as required; and transferring the weight of the collecting electrodes, discharge electrodes and high voltage frames from the temporary support truss assembly back to the repaired or replaced upper girder assembly of the electrostatic precipitator.

2. The method as defined in claim 1, wherein the method includes supporting the end vertical truss members of the temporary support truss assembly at the hot roof level of the electrostatic precipitator above the casing walls, side frames or partition frames of the electrostatic precipitator.

3. The method as defined in claim 2, wherein said method includes removing and replacing the hot roof of the electrostatic precipitator utilizing the temporary support truss assembly.

4. The method as defined in claim 1, wherein the casing walls of the electrostatic precipitator enclose a plurality of chambers separated by partition frames and fields, said method including building a temporary support truss assembly having a plurality of spaced vertical truss members and a plurality of horizontal truss members interconnected between said vertical truss members, supporting said vertical truss members on the casing walls, side frames or the partition frames with the temporary support truss assembly spanning a plurality of the chambers or fields of the electrostatic precipitator, then transferring the discharge electrodes, collecting electrodes and high voltage support frames in said chambers or fields to said horizontal truss members of said temporary support truss assembly.

5. The method as defined in claim 1, wherein said method includes welding brackets to the hot roof of the electrostatic precipitator above the frame assembly of the electrostatic precipitator.

6. A method of repairing an electrostatic precipitator comprising an enclosure including an upper girder assembly having high voltage support frames which support a plurality of discharge electrodes and anvil beams which support a plurality of collecting electrodes, comprising the following steps:

building a temporary support truss assembly having a length adapted to span casing walls of the electrostatic precipitator;

supporting the truss assembly on the casing walls of the electrostatic precipitator;

transferring the weight of the discharge electrodes and the collecting electrodes from the upper girder assembly to the temporary support truss assembly;

repairing or replacing components of the upper girder assembly; and transferring the weight of the discharge electrodes and the collecting electrodes from the temporary support truss assembly to the upper girder assembly.

7. The method as defined in claim 6, wherein said method includes lowering the high voltage support frames which support the discharge electrodes onto the collecting electrodes, then transferring the weight of the discharge electrodes and the collecting electrodes onto the temporary support truss assembly.

8. The method as defined in claim 7, wherein the method includes supporting the temporary support truss assembly on a hot roof of the electrostatic precipitator, then removing and replacing the hot roof utilizing the temporary support truss assembly.

* * * * *

UNITED STATES PATENT AND TRADEMARK OFFICE

CERTIFICATE OF CORRECTION

PATENT NO. : 7,468,094 B2
APPLICATION NO. : 11/702296
DATED : December 23, 2008
INVENTOR(S) : Rodney A. Hendricksen It is certified that error appears in the above-identified patent and that said Letters Patent is hereby corrected as shown below:

Title Page item 73
In the Assignee name, please delete "Hamon Research_Cottrell Inc." and add
--Hamon Research-Cottrell, Inc.--

Signed and Sealed this

Third Day of March, 2009

John Doll

JOHN DOLL
*Acting Director of the United States Patent and Trademark Office*